US005249772A

United States Patent [19]

Montie, Jr. et al.

[11] Patent Number: 5,249,772

[45] Date of Patent: Oct. 5, 1993

[54] STAND FOR CHRISTMAS TREE

[76] Inventors: Frank E. Montie, Jr.; Frank C. Montie, both of 682 Hatchery Rd., North Kingstown, R.I. 02852

[21] Appl. No.: 812,159

[22] Filed: Dec. 23, 1991

[51] Int. Cl.[5] ..... A47G 33/12

[52] U.S. Cl. ..... 248/523; 248/516; 47/40.5

[58] Field of Search ..... 248/523, 524, 527, 519, 248/520, 514, 515, 516; 47/40.5

[56] References Cited

U.S. PATENT DOCUMENTS

| | | | |
|---|---|---|---|
| 2,630,994 | 3/1953 | Dicoskey . | |
| 2,931,604 | 4/1960 | Weddle . | |
| 3,052,437 | 9/1962 | Schoen | 47/40.5 |
| 3,231,227 | 1/1966 | Weining | 47/40.5 |
| 3,250,504 | 5/1966 | Schwaderlapp | 47/40.5 |
| 4,156,323 | 5/1979 | Scheffler | 47/40.5 |
| 4,913,395 | 4/1990 | Juhas | 47/40.54 |

FOREIGN PATENT DOCUMENTS

| | | | |
|---|---|---|---|
| 243911 | 2/1912 | Fed. Rep. of Germany | 248/94 |

*Primary Examiner*—Alvin C. Chin-Shue

*Attorney, Agent, or Firm*—Salter, Michaelson & Benson

[57] ABSTRACT

A stand for a Christmas tree includes an inner portion which is securable to the trunk portion of a Christmas tree and a base portion which is adapted for receiving the inner portion and the trunk portion therein in order to support the Christmas tree in a substantially upright disposition on a supporting surface. The stand further includes a centering assembly for centering the inner portion and the bottom end of the trunk portion of the Christmas tree relative to the base portion and a plurality of securing arms on the inner portion which are engageable with the base portion for adjustably securing the angular position of the Christmas tree relative to the stand.

7 Claims, 2 Drawing Sheets

STAND FOR CHRISTMAS TREE

BACKGROUND AND SUMMARY OF THE INVENTION

The instant invention relates to Christmas decorations, and more particularly to an effective and easy to use stand for a Christmas tree.

A wide variety of different types of stands have been heretofore available for supporting Christmas trees and the like. In this regard, most of the heretofore available stands have included means for angularly adjusting Christmas trees received therein so that they can be more effectively utilized for supporting Christmas trees in substantially vertical dispositions. However, it has been found that it can often be a difficult and tedious task to properly adjust the angular orientation of a Christmas tree once it is received in a stand, and that it is often not practical to secure a stand to a Christmas tree prior to positioning the Christmas tree in an upright disposition. Accordingly, it has been found that there is a need for an improved stand which can be more easily assembled on a Christmas tree and simply and easily adjusted to orient the Christmas tree in a substantially vertical disposition.

The instant invention provides an improved stand which is adapted to be readily and easily assembled on the trunk portion of a Christmas tree, and thereafter readily and easily adjusted to adjust the angular orientation of the Christmas tree. More specifically, the instant invention provides a Christmas tree stand comprising a base portion which is adapted to be received on a supporting surface, and an inner portion which is removable from the base portion and adapted to be secured to the trunk portion of a Christmas tree. Accordingly, the inner portion can be assembled with the trunk portion of a Christmas tree while the Christmas tree is in a horizontal, or laying down, disposition, and thereafter the Christmas tree and the inner portion can be assembled with the base portion for retaining the Christmas tree in an upright disposition. The Christmas tree further includes a pair of centering members for centering the inner portion of the stand and the lower end of the trunk portion of a Christmas tree received therein relative to the base portion and a plurality of securing members for securing the inner portion, and the Christmas tree to the base portion so that the inner portion and the Christmas tree are angularly adjustable relative to the base portion. One of the centering members is preferably permanently attached to the inner portion, and the other centering member is preferably permanently attached to the base portion, and the centering members are preferably of at least partially complimentary configuration, so that they are receivable in interfitting relation to center the inner portion and the lower end of the trunk portion of a Christmas tree relative to the base portion. The base portion preferably has an upper rim portion, and the means for securing the inner portion to the base portion preferably comprises a plurality of arms which are pivotally attached to the inner portion and engageable with the rim portion of the base portion for securing the inner portion relative to the base portion, so that it is angularly adjustable with respect thereto. Each of the arms preferably has a plurality of downwardly opening slots therein which are engageable with the rim portion for adjusting the angular position of the inner portion and a Christmas tree received therein relative to the base portion. The inner portion preferably includes a band-like clamp which is adapted for encircling the trunk portion of a Christmas tree in order to secure the inner portion thereto, and the base portion is preferably formed in the configuration of an enlarged housing for containing a quantity of water therein in order to maintain a Christmas tree received therein in a fresh condition.

It has been found that the Christmas tree stand of the instant invention can be readily and easily assembled on the trunk portion of a Christmas tree, and that it can thereafter be effectively utilized for supporting the Christmas tree in an upright disposition. Specifically, it has been found that the inner portion of the stand is readily and easily securable to the trunk portion of a Christmas tree. Further, it has been found that once the inner portion has been assembled on the trunk portion of the Christmas tree, the inner portion and the trunk portion can be readily and easily assembled in the base portion so that the lower end of the trunk portion is centered relative to the base portion, and so that the angular orientation of the Christmas tree can be readily and easily adjusted by manipulating the securing arms and adjusting the angular position of the inner portion and the trunk portion relative to the base portion.

Devices representing the closest prior art to the subject invention of which the applicant is aware are disclosed in the U.S. Pat. No. 2,630,994 to Dicoskey; and U.S. Pat. No. 2,931,604 to Weddle. However, while those references relate to two-piece Christmas tree stands, they fail to suggest a stand which includes a centering assembly, or a securing assembly of the type included in the stand of the subject invention, and hence, they are believed to be of only general interest with respect thereto.

Accordingly, it is a primary object of the instant invention to provide an improved Christmas tree stand which is adapted to be readily and easily assembled on the trunk portion of a Christmas tree and readily and easily adjusted to orient the Christmas tree in a substantially vertical disposition.

Another object of the instant invention is to provide an effective Christmas tree stand comprising an inner portion which is adapted to be assembled on a Christmas tree, and a base portion which is adapted for receiving the inner portion therein and for supporting a Christmas tree assembled with the inner portion in a substantially upright disposition on a supporting surface.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
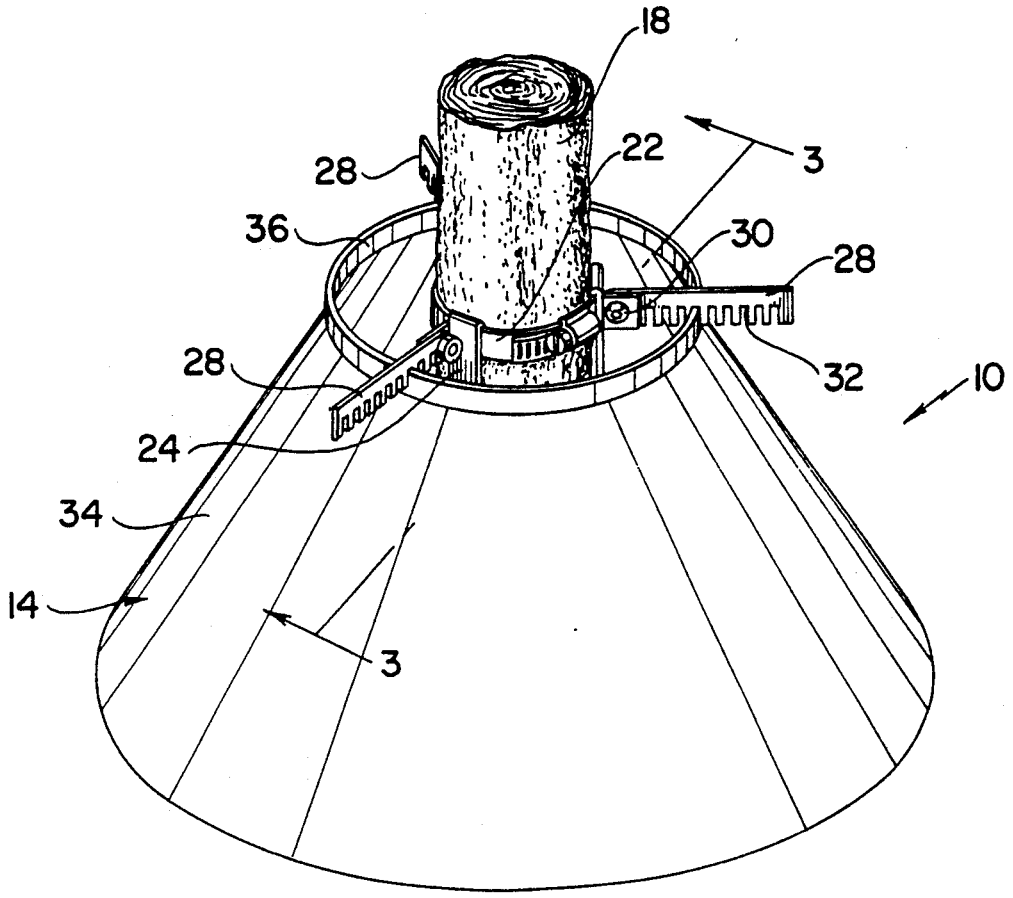
FIG. 1 is a perspective view of the Christmas tree stand of the instant invention with the trunk portion of a Christmas tree received therein.
Figure 2:
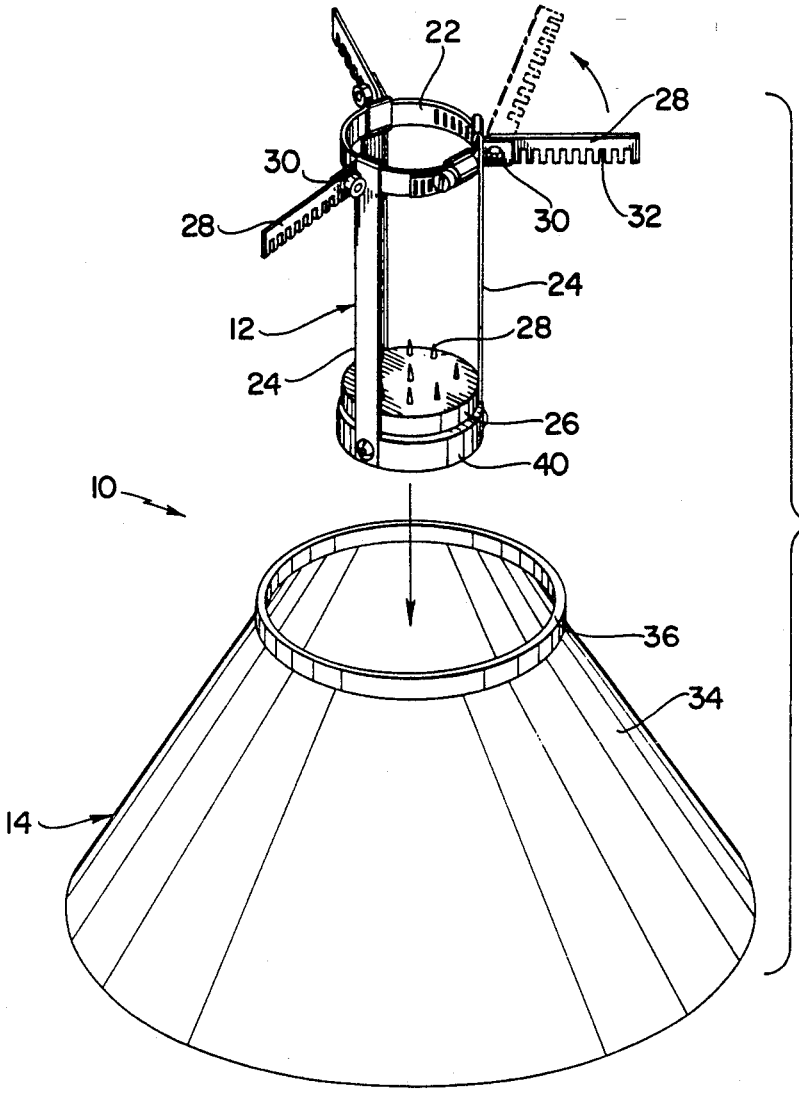
FIG. 2 is an exploded perspective view of the stand.
Figure 3:
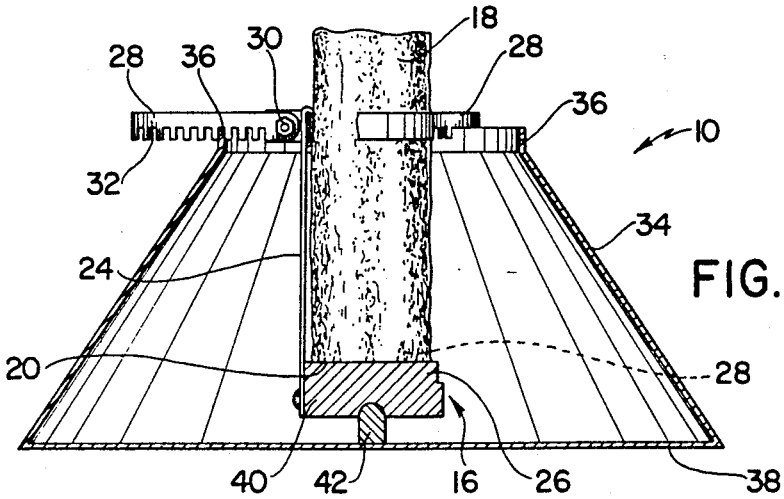
FIG. 3 is a sectional view taken along the line 3—3 in FIG. 1.

Referring now to the drawings, the Christmas tree stand of the instant invention is illustrated in FIGS. 1 through 3, and generally indicated at 10. The Christmas tree stand 10 comprises an inner portion generally indicated at 12, a base portion generally indicated at 14, a centering assembly generally indicated at 16, and a securing assembly generally indicated at 17. The inner portion 12 is adapted for receiving a trunk portion 18 of a Christmas tree therein, the trunk portion being substantially free of side branches and having a lower end 20, and the inner portion 12 is receivable in the base portion 14 and securable therein with the securing assembly 17 for supporting the Christmas tree in a substantially upright disposition on a supporting surface. The centering assembly 16 is operative for centering the lower end 20 of the Christmas tree relative to the base portion 14 and the securing assembly 17 is adapted for adjustably securing the inner portion 12 relative to the base portion 14 so that the angular disposition of the Christmas tree received in the inner portion 12 can be easily adjusted.

The inner portion 12 comprises an upper clamp member 22 which is adapted to be received in encircling relation around the trunk portion 18 and secured to the trunk portion 18 by tightening the clamp portion 22. The inner portion 12 further comprises a plurality of downwardly extending legs 24 which extend downwardly to a bottom end portion 26 having a plurality of upwardly extending prongs 28 thereon. The bottom end portion 26 is preferably formed in a weighted construction, and it is integrally formed with a portion of the centering assembly 16, as will hereinafter be more fully set forth.

The securing assembly 17 comprises a plurality of securing arms 28 which are pivotally attached to the clamp portion 22 as at 30. Each of the securing arms 28 has a plurality of spaced downwardly opening slots 32 formed therein which are engageable with the base portion 14 for securing the angular position of the inner portion 12 relative to the base portion 14 in a manner which will also hereinafter be more fully set forth.

The base portion 14 comprises a housing which, as hereinembodied, includes a frusto-conical sidewall portion 34, an upper rim 36, and a bottom wall 38. The base portion 14 can be effectively constructed of a suitable metal or plastic material, and it is adapted for receiving a quantity of water therein in order to maintain a Christmas tree received in the stand 10 in a fresh condition. The upper rim portion 36 is substantially vertically disposed when the base portion 14 is received on a supporting surface and it is dimensioned to be received in the slots 32 in the securing arms 28 of the inner portion 12. Accordingly, the securing arms 28 are operable in cooperation with the rim portion 36 for adjustably securing the angular position of the inner portion 12 relative to the base portion 14.

The centering assembly 16 comprises an upper first centering member 40 which is integrally formed with the bottom end portion 26 of the inner portion 12, and a lower second centering member 42 which is permanently secured in a substantially center position on the upper side of the bottom wall 38. The centering members 40 and 42 are formed in at least partially complimentary configurations so that they are receivable in interfitting engagement in order to center the first centering member 40 and the lower end of the inner portion 12 relative to the base portion 14, when the inner portion 12 is received in the base portion 14. Accordingly, when the trunk portion 18 is received in the inner portion 12 and the inner portion 12 is assembled in the base portion 14, the lower end 20 of the trunk portion 18 is centered relative to the bottom wall 38 of the base portion 14.

Accordingly, for use and operation of the stand 10, the inner portion 12 is assembled on the trunk portion 18 of a Christmas tree, so that the lower end 20 is received on the bottom end portion 26 with the prongs 28 penetrating into the lower end 20. The clamp portion 22 is then tightened around the trunk portion 18 in order to secure the inner portion 12 to the trunk portion 18. Thereafter, the inner portion 12 with the trunk portion 18 of a Christmas tree received therein can be readily and easily assembled with the base portion 14, in order to support the Christmas tree in a substantially upright disposition on a substantially horizontal supporting surface. Specifically, the inner portion 12 and the trunk portion 18 of the Christmas tree are assembled in the base portion 14 so that the first centering member 40 is received in interfitting engagement with the second centering member 42 in order to center the lower end 20 of the Christmas tree. Thereafter, the angular disposition of the Christmas tree can be readily and easily adjusted relative to the base portion 14 by adjusting the positions of the arms 28 relative to the rim portion 36. Specifically, this is carried out by orienting the arms 28 so that the rim portion 36 is received in the appropriate slots 32 for securing the desired angular orientation of the trunk portion 18 and the remaining portions of the Christmas tree relative to the base portion 14.

It is seen therefore that the instant invention provides an effective Christmas tree stand. The stand 10 is adapted so that the inner portion 12 can be easily assembled on the trunk portion 18 of a Christmas tree prior to assembling the Christmas tree and the inner portion 12 with the base portion 14. Accordingly, the inner portion 12 can be assembled on the Christmas tree while the Christmas tree is in a laying down position in order to facilitate the assembly of the inner portion 12 thereon. Thereafter, the inner portion 12 and the Christmas tree can be readily and easily assembled in the base portion 14, so that the lower end 20 of the Christmas tree is centered relative to the base portion, and so that the Christmas tree is easily angularly adjustable to a substantially vertical disposition. Hence, it is seen that the instant invention represents a significant improvement in the art relating to Christmas tree stands which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

I claim:

1. A stand for a Christmas tree, said Christmas tree including a trunk portion which terminates in a lower end, said trunk portion being substantially free of side branches, said stand comprising a base portion having an upper rim, and an inner portion, said inner portion being adapted for receiving said trunk portion therein and including means for securing said inner portion to said trunk portion, said base portion being adapted for releasably receiving said inner portion and said trunk portion therein and for supporting said tree in a substantially upright disposition on a supporting surface, said stand further comprising centering means for orienting the lower end of said trunk portion in a substantially centered position relative to said base portion as said inner portion and said trunk portion are assembled in said base portion and for retaining the lower end of said trunk portion in said centered position, said centering means comprising a first centering member on said inner portion, and a second centering member on said base portion, said first and second centering members being releasably receivable in mating interfitting engagement for centering said trunk portion relative to said base portion when said trunk portion is received in said inner portion, said first centering member being pivotable relative to said second centering member with said first and second centering members received in mating interfitting engagement for adjusting the angular position of said inner portion and said trunk portion relative to a vertical axis, and means for securing said inner portion to said base portion so that said inner portion and said trunk portion are angularly adjustable relative to said vertical axis, said securing means comprising a plurality of arms connecting said inner portion to said upper rim.

2. In the stand of claim 1, said first and second centering members being of at least partially complimentary configuration.

3. In the stand of claim 1, said arms being pivotally mounted on said inner portion, said arms being engageable with said rim for securing said inner portion to said trunk portion.

4. In the stand of claim 3, each of said arms having a plurality of downwardly opening slots therein, said rim portion being receivable in said slots for securing said inner portion relative to said base portion.

5. In the stand of claim 3, said arms being pivotally mounted on said inner portion in upwardly spaced relation to said lower end when said trunk portion is received in said inner portion.

6. In the stand of claim 1, said means for securing said inner portion to said trunk portion including clamp means for encircling said trunk portion to secure said inner portion thereto.

7. In the stand of claim 6, said inner portion including a bottom member for receiving said lower end of said trunk portion thereon, and a plurality of legs extending upwardly from said bottom member, said clamp means being attached to said legs in upwardly spaced relation to said bottom member.

* * * * *